US009696084B1

(12) United States Patent
Kalva et al.

(10) Patent No.: US 9,696,084 B1
(45) Date of Patent: Jul. 4, 2017

(54) LIGHT SWITCH FOR DOOR IN DOOR REFRIGERATOR

(71) Applicant: Haier US Appliance Solutions, Inc., Wilmington, DE (US)

(72) Inventors: Phani Kumar Kalva, Hyderabad (IN); Bagawathkumar Chellappan, Louisville, KY (US); Satish Gundala, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/265,893

(22) Filed: Sep. 15, 2016

(51) Int. Cl.
*F25D 27/00* (2006.01)
*F25D 23/02* (2006.01)
*F25D 25/00* (2006.01)

(52) U.S. Cl.
CPC ..... *F25D 27/00* (2013.01); *F25D 23/02* (2013.01); *F25D 25/005* (2013.01); *F25D 2323/023* (2013.01)

(58) Field of Classification Search
CPC ..... F25D 27/00; F25D 27/005; F25D 23/025; F25D 23/028; F25D 2323/023
See application file for complete search history.

(56) References Cited

U.S. PATENT DOCUMENTS 3,881,077 A * 4/1975 Piber ..... F25D 27/00 200/296
4,300,025 A * 11/1981 Prada ..... F25D 27/00 200/283
6,150,622 A * 11/2000 Malnati ..... F25D 29/005 200/61.62
2002/0003083 A1* 1/2002 Park ..... H01H 3/161 200/61.76
2010/0320890 A1* 12/2010 Jung ..... F25D 27/00 312/402
2012/0286638 A1* 11/2012 Lee ..... F25D 23/02 312/405
2013/0033163 A1* 2/2013 Kang ..... F25D 23/04 312/405.1
2015/0260447 A1* 9/2015 Kim ..... F25D 27/005 312/405
2016/0356541 A1* 12/2016 Giacomini ..... F25D 23/028

* cited by examiner

*Primary Examiner* — Daniel Rohrhoff
(74) *Attorney, Agent, or Firm* — Dority & Manning, P.A.

(57) ABSTRACT

A refrigerator appliance having a cabinet defining a food storage chamber, a first door, a second door rotatably mounted to the outer surface of the first door, a light, a switch in operative communication with the light, and an actuator. The switch and actuator are configured to turn the light on when the first door is in the open position, to turn the light on when the second door is in the open position, and to turn the light off when both the first door and the second door are in the respective closed positions.

18 Claims, 11 Drawing Sheets

LIGHT SWITCH FOR DOOR IN DOOR REFRIGERATOR

FIELD OF THE INVENTION

The subject matter of the present disclosure relates generally to refrigerator appliances.

BACKGROUND OF THE INVENTION

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In order to facilitate visibility of food items stored therein, refrigerator appliances typically include a light positioned within the food storage chamber(s). A switch is typically provided to illuminate the light when the insulated sealing door or doors is/are opened.

In order to facilitate accessibility of food items stored therein, the cabinet of the refrigerator appliance may contain multiple food storage chambers provided to store items of different sizes and/or at different conditions. In such appliances, multiple doors may be provided. Multiple doors can be provided in side-by-side, top and bottom, inner and outer arrangements, or various combinations thereof.

When multiple doors are provided, a plurality of food storage chambers may be thereby created. For example, many typical refrigerators have only one fresh food storage chamber, whereas providing multiple doors can create distinct fresh food storage chambers. In such cases with multiple chambers, it can be difficult to provide adequate lighting for each chamber while also making the lighting responsive to opening any one of the multiple doors. Typically, refrigerator appliances may include a switch and associated wiring for each of the multiple doors to illuminate the light whenever any one of the doors is opened. However, providing multiple switches and accompanying wiring for each of the multiple doors can be difficult and costly.

Accordingly, a refrigerator having an improved means for selectively illuminating the light when any one of the multiple doors is open without separately wiring individual switches for each door would be useful.

BRIEF DESCRIPTION OF THE INVENTION

Additional aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a first food storage chamber, the first food storage chamber extending between a top portion and a bottom portion along the vertical direction, a first side portion and a second side portion along the lateral direction, and a front portion and a back portion along the transverse direction, the front portion of the first food storage chamber defining an opening for receipt of food items. An inner door comprising an outer surface and an opposing inner surface is positioned at the front portion of the food storage chamber and movable between a closed position and an open position to selectively sealingly enclose the first food storage chamber. An outer door is rotatably mounted to the outer surface of the inner door, the outer door comprising an outer surface and an opposing inner surface. A second food storage chamber is defined between the inner door and the outer door, the outer door is movable between an open position and a closed position to permit selective access to the second food storage chamber. A light is positioned for illuminating the first food storage chamber and the second food storage chamber, a switch is positioned within the cabinet and in operative communication with the light. An actuator is movable between a forward position proximate the outer surface of the inner door and a back position proximate the inner surface of the inner door, wherein the actuator engages the switch to deactivate the light when the inner door is in the closed position and the actuator is in the back position. A biasing member is engaged with the actuator to bias the actuator towards the forward position.

In a second exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber, the food storage chamber comprises an opening positioned at a front portion of the food storage chamber, a nesting door assembly mounted at a front portion of the cabinet, the nesting door assembly comprising an inner door, an outer door, and a latch operable to selectively lock the inner door and the outer door together and unlock the inner door and the outer door to permit each door to move independently of the other, the inner door movable between an open position and a closed position to permit selective access to the food storage chamber, the outer door movable between an open position and a closed position to permit selective access to a portion of the food storage chamber, a light positioned to illuminate the food storage chamber; and a switch apparatus in operative communication with the light, wherein the switch apparatus is configured to turn the light on when the inner door is in the open position, to turn the light on when the outer door is in the open position, and to turn the light off when both the inner door and the outer door are in the respective closed positions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
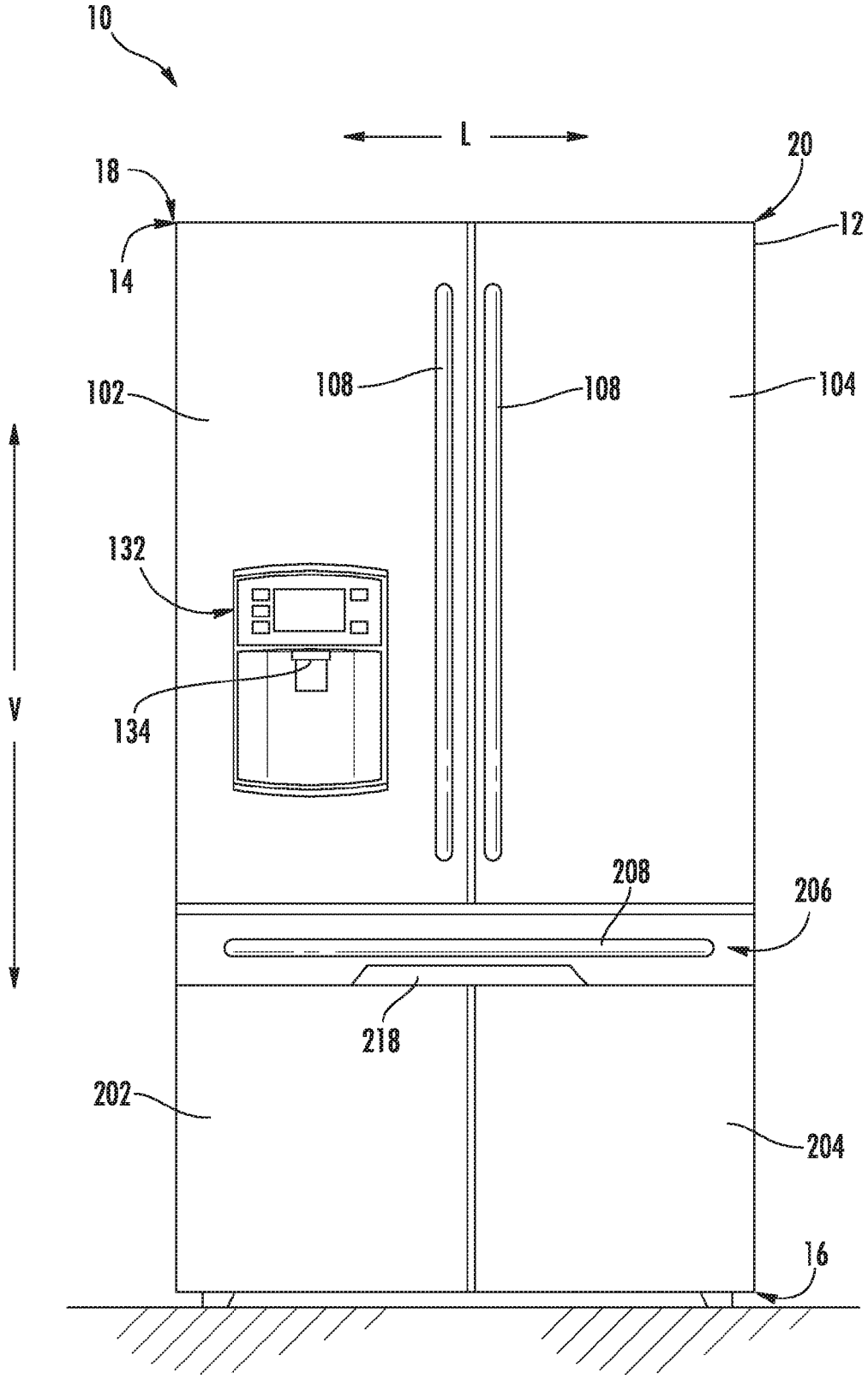
FIG. 1 provides a front elevation view of a refrigerator appliance according to an exemplary embodiment of the present subject matter with the doors shown in the closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

The present subject matter provides a refrigerator appliance 10 having a cabinet 12 that includes a first food storage chamber 100 or 200. An inner door or frame door 105 or 205 is provided to selectively sealingly enclose the first food storage chamber 100 or 200. An outer door 104 or doors 202, 204 is/are rotatably mounted to the outer surface of the inner door 105 or 205. A second food storage chamber 101 or 201 can be defined between the inner door 105 or 205 and the outer door(s) 104 or 202, 204. The outer door(s) 104 or 202, 204 can be movable between an open position and a closed position to permit selective access to the second food storage chamber 101 or 201. The second food storage chamber 101 or 201 may be contiguous with the first food storage chamber 100 or 200 or may be isolated from the first food storage chamber 100 or 200. In various embodiments, the first and second food storage chambers 100, 101 or 200, 201 can be configured to provide generally the same storage conditions, e.g., temperature and/or humidity, or they can be configured to provide distinct conditions suitable for particular types of food items. A light 300 is provided to illuminate the first and second food storage chambers 100, 101 or 200, 201 when either the inner door 105 or 205 or outer door(s) 102 or 202, 204 is opened. A switch 350 and an actuator 150 are provided which facilitate the activation of the light 300 upon opening one of the doors 104, 105, 202, 204, and/or 205 without the need for electrical wiring outside of the cabinet 12 of the refrigerator appliance 10. In other words, the actuator 150 is a mechanical actuator with no wiring required to make the light 300 responsive to the outer door(s) 104 or 202, 204. The disclosed switch 350 and actuator 150 can be used with any type or combination of refrigerator appliance doors. For example, one or both refrigerator doors 102, 104 can be an outer door 104 with an inner door 105 and a coupled thereto, such that the disclosed switch 350 and actuator 150 can be used to selectively illuminate the light 300 when one of the doors 102, 104, and/or 105 is opened. Additionally or in the alternative, the disclosed switch 350 and actuator 150 can be used with a freezer door 205 that is either a rotatable door (not shown) or a front portion of a slidable drawer (e.g., FIG. 3) in combination with additional outer freezer doors 202, 204.

Figure 2:
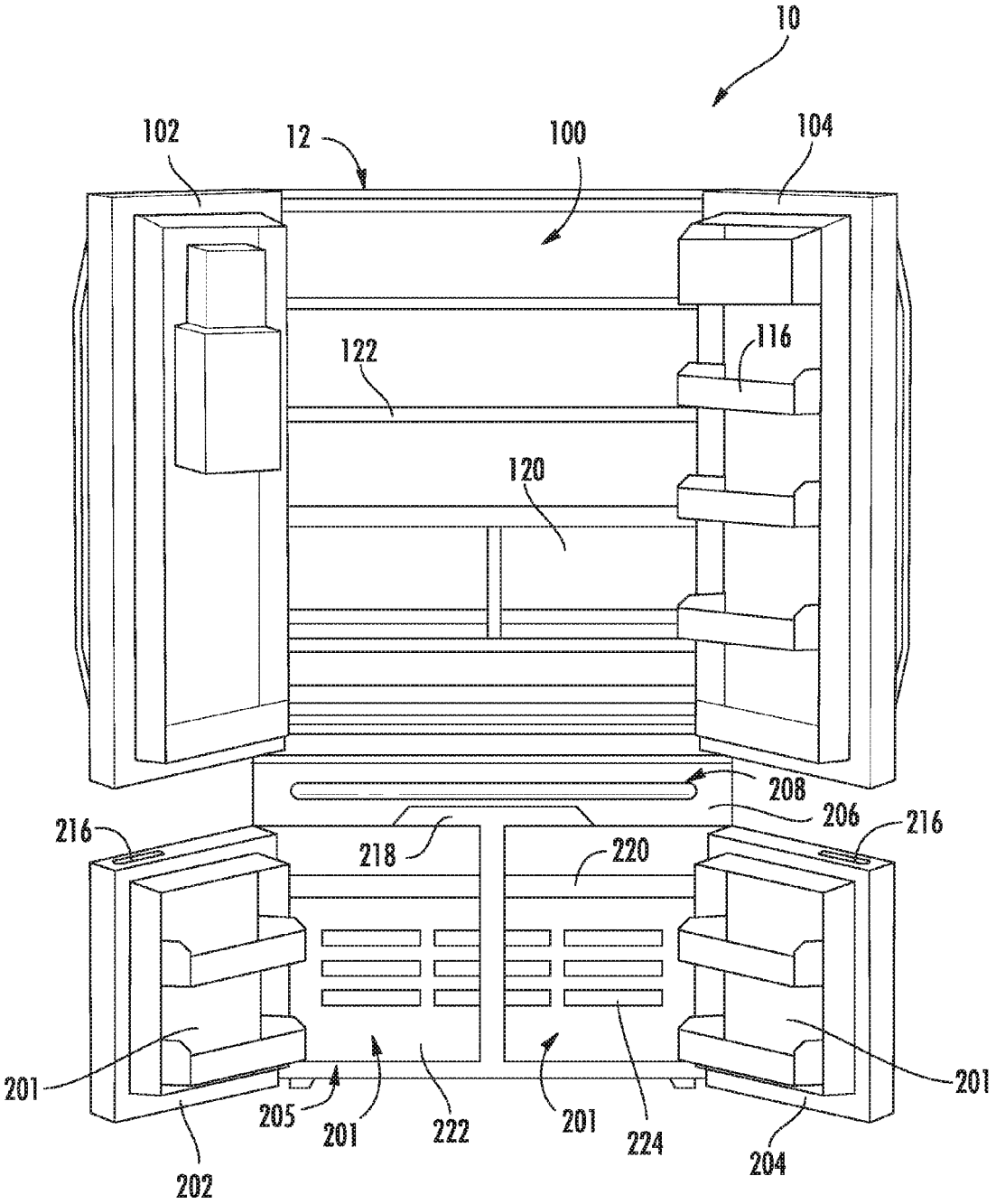
FIG. 2 provides a front elevation view of the exemplary refrigerator appliance of FIG. 1 with the doors of the exemplary refrigerator appliance shown in an open position.

FIG. 1 provides a front, elevation view of a refrigerator appliance 10 according to an exemplary embodiment of the present subject matter wherein the inner door is provided as a front portion 205 of freezer drawer 206 and outer doors 202 and 204 are provided outboard of the inner freezer door 205. As illustrated in FIG. 1, some embodiments of the refrigerator appliance 10 can include doors 102, 104, 202, 204, and 205 which are shown in a closed position in FIG. 1. FIG. 2 provides a front, elevation view of refrigerator appliance 10 with doors 102, 104, 202, 204, and 205 shown in an open position.

Refrigerator appliance 10 defines a vertical direction V, a lateral direction L, and a transverse direction T (see, e.g., FIG. 3), each mutually perpendicular to one another. As may be seen in, e.g., FIGS. 1, 2, 3, and 5, refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T (see, e.g., FIG. 3).

As depicted, cabinet 12 defines chilled chambers 100, 200 for receipt of food items for storage. In particular, cabinet 12 defines first fresh food chamber 100 (FIG. 2) positioned at or adjacent top 14 of cabinet 12 and a first frozen food storage chamber 200 (FIG. 3) arranged at or adjacent bottom 16 of cabinet 12. In some embodiments, the refrigerator appliance may include a second fresh food storage chamber 101 defined between inner door 105 and outer door 104 (e.g., FIG. 8). In some embodiments, the refrigerator appliance 10 may include a second frozen food storage chamber 201 defined between inner door 205 and outer doors 202, 204 (e.g., FIGS. 2 and 3). The illustrated exemplary refrigerator appliance 10 is generally referred to as a bottom mount refrigerator. It is recognized, however, that the benefits of the present disclosure apply to other types and styles of refrigerators such as, for example, a top mount refrigerator, a side-by-side style refrigerator, or a freezer appliance. Consequently, the description set forth herein is for illustrative purposes only and is not intended to be limiting in any aspect to a particular refrigerator chamber configuration.

Refrigerator doors 102, 104, and in some embodiments, 105, are rotatably mounted to cabinet 12, e.g., such that the doors permit selective access to fresh food storage chamber 100 of cabinet 12. As shown in the illustrated embodiments, refrigerator doors include a left refrigerator door 102 rotatably mounted to cabinet 12 at left side 18 of cabinet 12 and a right refrigerator door 104 rotatably mounted to cabinet 12 at right side 20 of cabinet 12. In some embodiments, such as those illustrated in FIGS. 5 and 6, right refrigerator door 104 can be the outer door of a nested door assembly, and a portion of outer door 104 can be received within a frame 106 of the inner door 105 of the nested door assembly to define a second fresh food storage chamber 101.

Figure 6:
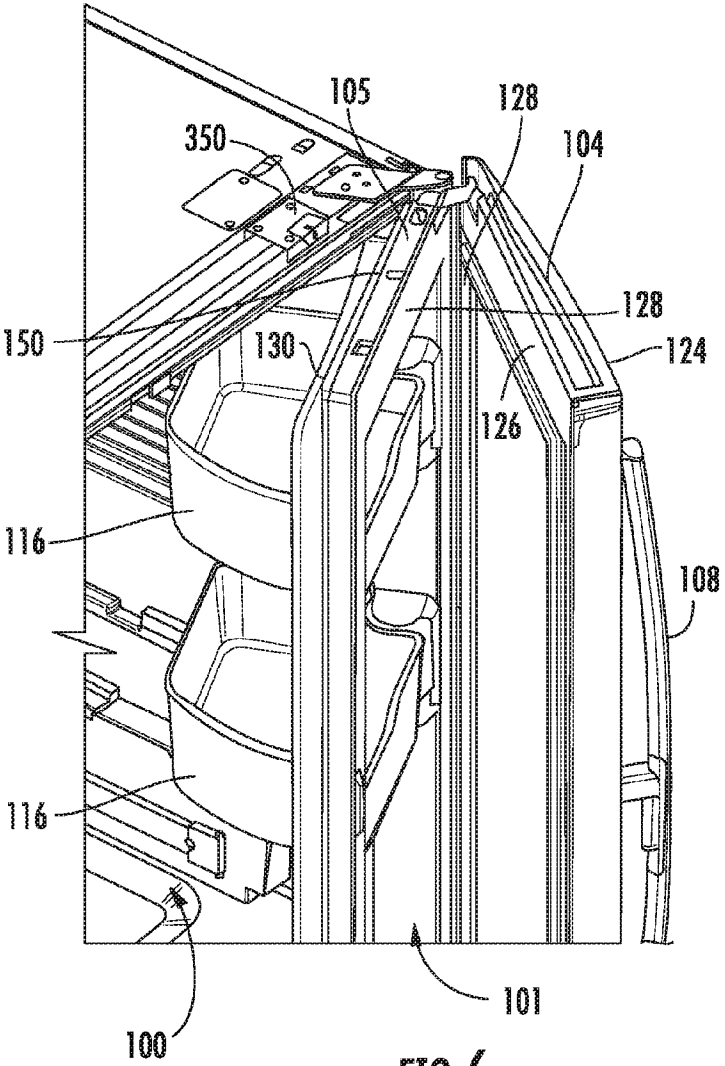
FIG. 6 provides a perspective view of the exemplary refrigerator appliance of FIG. 5 with the doors of the exemplary refrigerator appliance in an unlocked, partially open position FIG. 7 provides an enlarged view of a portion of FIG. 6 including an exemplary latch.

As shown for example in FIG. 2, various storage components are mounted within fresh food chamber 100 to facilitate storage of food items therein as will be understood by those skilled in the art. In particular, the storage components include bins 116, drawers 120, and shelves 122 that are mounted within fresh food chamber 100. Bins 116, drawers 120, and shelves 122 are configured for receipt of food items (e.g., beverages and/or solid food items) and may assist with organizing such food items. In some embodiments, for example as shown in FIG. 6, opening outer door 104 permits access to bins 116. In such embodiments, when inner door 105 and outer door 104 are both in the closed position, bins 116 are disposed partially within the first fresh food storage chamber 100 and partially within second fresh food storage chamber 101, i.e., in such embodiments the fresh food storage chambers 100, 101 are contiguous.

In some embodiments, a freezer drawer 206 is arranged below refrigerator doors 102, 104 for selectively accessing items stored in frozen food storage chamber 200. Freezer drawer 206 is slidably mounted to cabinet 12 and can be selectively moved in and out of frozen food storage chamber 200 along transverse direction T. In one or more embodiments, each freezer door 202 and 204 may provide an outer door coupled to the freezer drawer 206, as illustrated in, e.g., FIGS. 2 and 3, wherein the front portion 205 of freezer drawer 206 provides the inner door. More specifically, freezer doors 202, 204 can include a first freezer door 202 and a second freezer door 204 rotatably mounted at a front portion 205 (FIGS. 3 and 4) of the freezer drawer 206 on the left side 18 and right side 20 of cabinet 12, respectively. The exemplary embodiment of freezer drawer 206 shown in FIG. 2 is provided by way of example only. Other freezer configurations are within the scope of the present subject matter.

Figure 3:
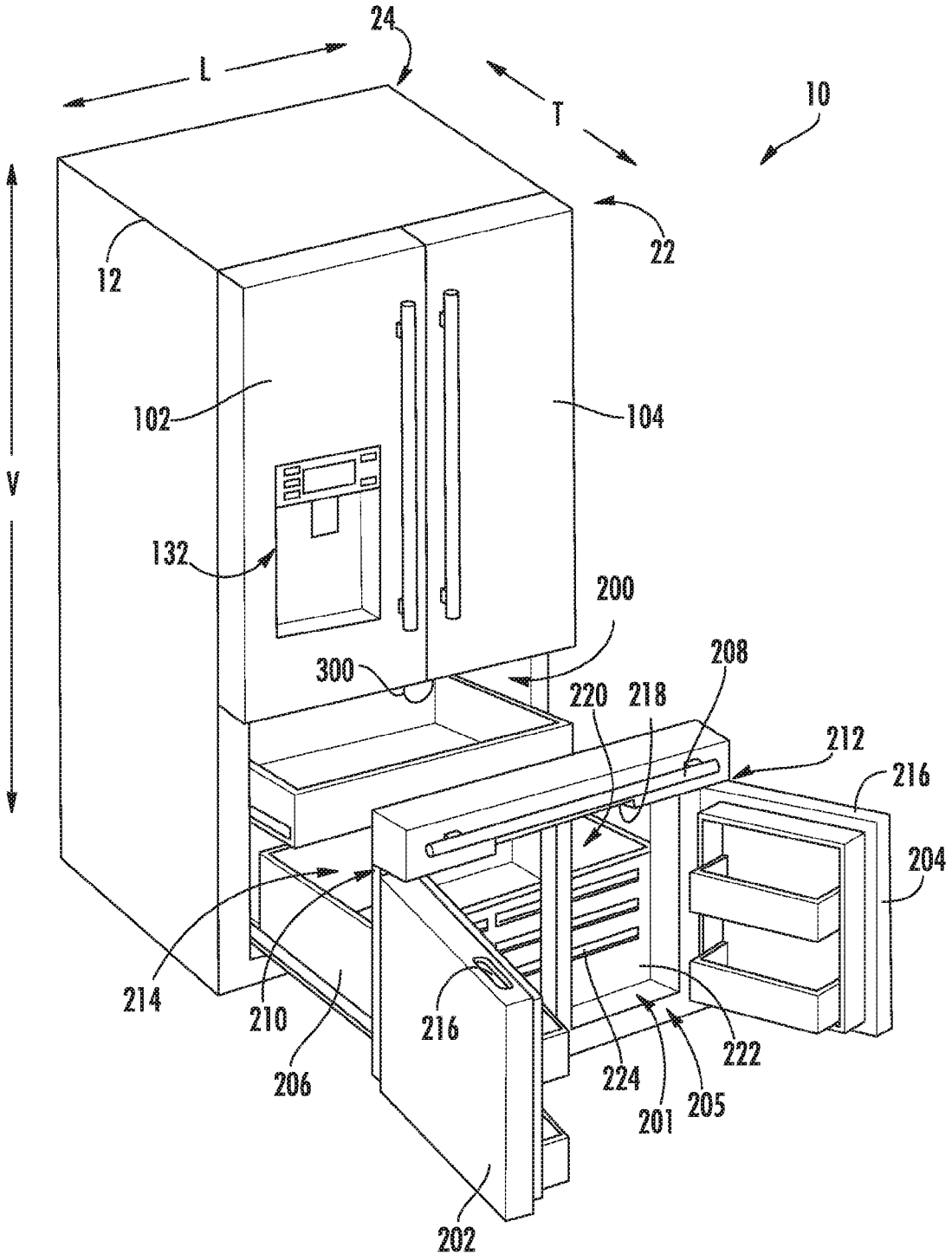
FIG. 3 provides a perspective view of the exemplary refrigerator appliance of FIG. 1 with the doors of the exemplary refrigerator appliance in the open position.
Figure 4:
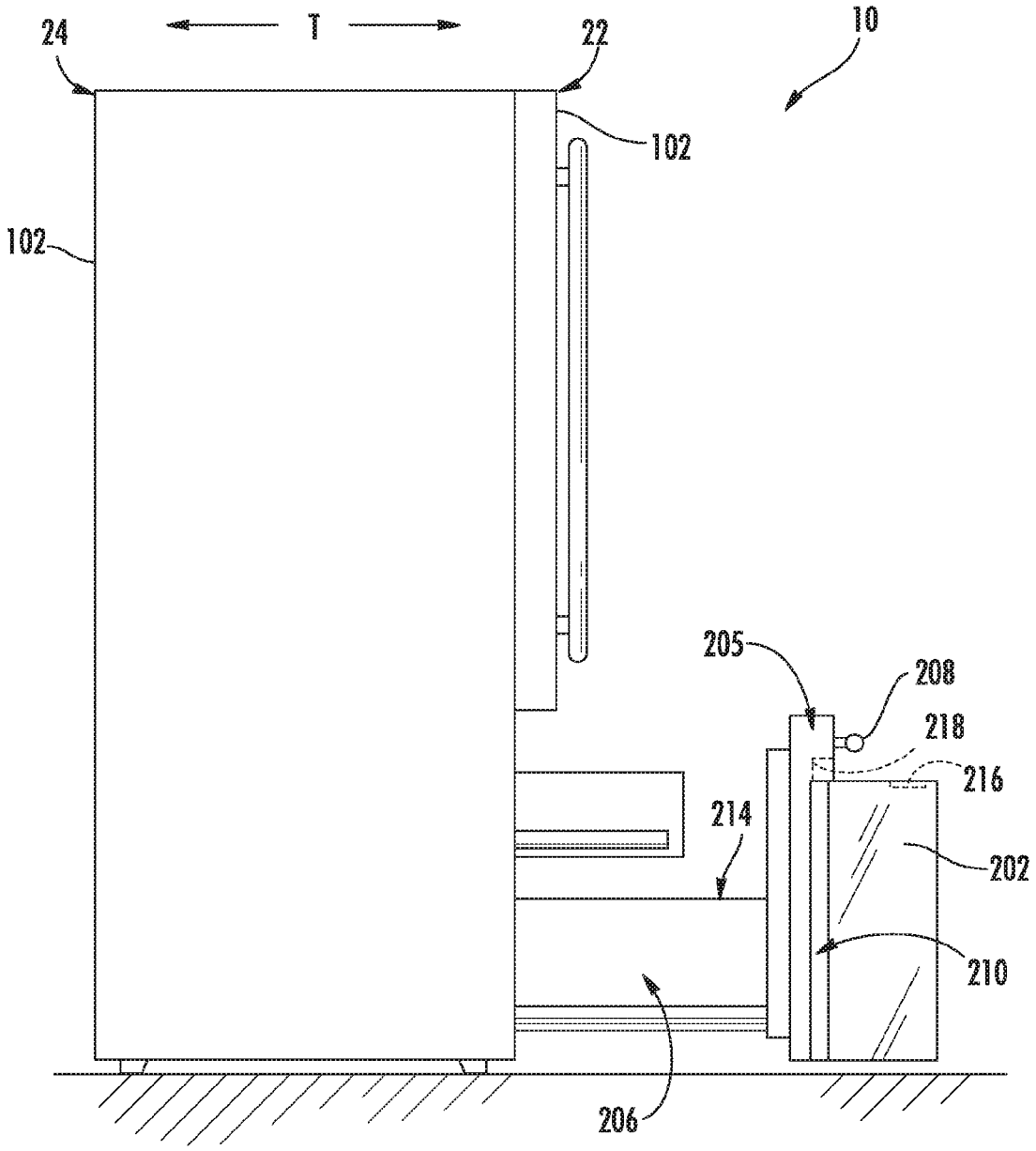
FIG. 4 provides a side view of the exemplary refrigerator appliance of FIG. 1 with the freezer drawer and the freezer doors of the exemplary refrigerator appliance in the open position.

In some embodiments such as in the illustrated example embodiment of FIG. 3, outer freezer doors 202, 204 are rotatably mounted to the front portion 205 at vertically extending notches 210, 212 respectively. In this manner, outer freezer doors 202, 204 may be rotated between an open position and a closed position within a plane that includes both the lateral (L) and transverse (T) directions to permit selective access to the second frozen food storage chamber 201. Thus, it is possible to access the second frozen food storage chamber 201 independently of first frozen food storage chamber 200, e.g., by opening the freezer doors 202, 204 without having to open or slide out the freezer drawer 206. Such allows relatively quicker access to items stored in the second frozen food storage chamber 201 as compared to first frozen food storage chamber 200.

In some embodiments where second frozen food storage chamber 201 is contiguous with first frozen food storage chamber 200, front portion 205 may define at least one opening 220 (FIG. 3) between the second frozen food storage chamber 201 and the first frozen food storage chamber 200 (e.g., storage volume 214 of the freezer drawer 206). In this manner, the first frozen food storage chamber 200 may be accessed by opening one or more of the outer freezer doors 202, 204 without having to open the inner door 205, e.g., without having to slide out the freezer drawer 206.

Additionally, in some embodiments, a divider panel 222 may be positioned at inner door 205 between first frozen food storage chamber 200 and second frozen food storage chamber 201. This divider panel 222 may be solid and extend the full length and height of inner door 205, as well as may include insulation (not shown) to thermally isolate second frozen food storage chamber 201 from first frozen food storage chamber 200 such that second frozen food storage chamber 201 can provide distinct conditions (e.g., temperature and/or humidity) from those of first frozen food storage chamber 200. Additionally in such embodiments, alternative means for delivering cooling air to the second frozen food storage chamber 201 separately from first frozen food storage chamber 200 may be provided. In the exemplary embodiment illustrated in FIGS. 2 and 3, the divider panel 222 may include a series of apertures 224 to permit cooling air to reach the second frozen food storage chamber 201 such that second frozen food storage chamber 201 is configured to provide generally the same storage conditions as first frozen food storage chamber 200. Similar embodiments may be implemented in the context of fresh food storage chamber 100, e.g., with divider panel 136 (as illustrated in the example embodiments of FIGS. 9 and 10) between first fresh food storage chamber 100 and second fresh food storage chamber 101 which may provide varying extents of isolation between fresh food storage chambers 100 and 101. e.g., with apertures (not shown) in divider panel 136 or with a solid, insulated divider panel 136.

In the illustrated embodiments, refrigerator appliance 10 also includes a dispensing assembly 132 for dispensing liquid water and/or ice. Dispensing assembly 132 includes a dispenser 134 positioned on or mounted to an exterior portion of refrigerator appliance 10, e.g., on one of the refrigerator doors 102, 104. Accordingly, in the example embodiments illustrated in FIGS. 5 and 6, a single inner door 105 is provided corresponding to right refrigerator door 104, while dispensing assembly 132 is provided in left refrigerator door 102. One skilled in the art will recognize that other embodiments not specifically illustrated are possible, e.g., dispensing assembly 132 could be provided in right refrigerator door 104 and an inner door 105 could correspond to left refrigerator door 102, or both refrigerator doors 102 and 104 could have a corresponding inner door 105.

Figure 5:
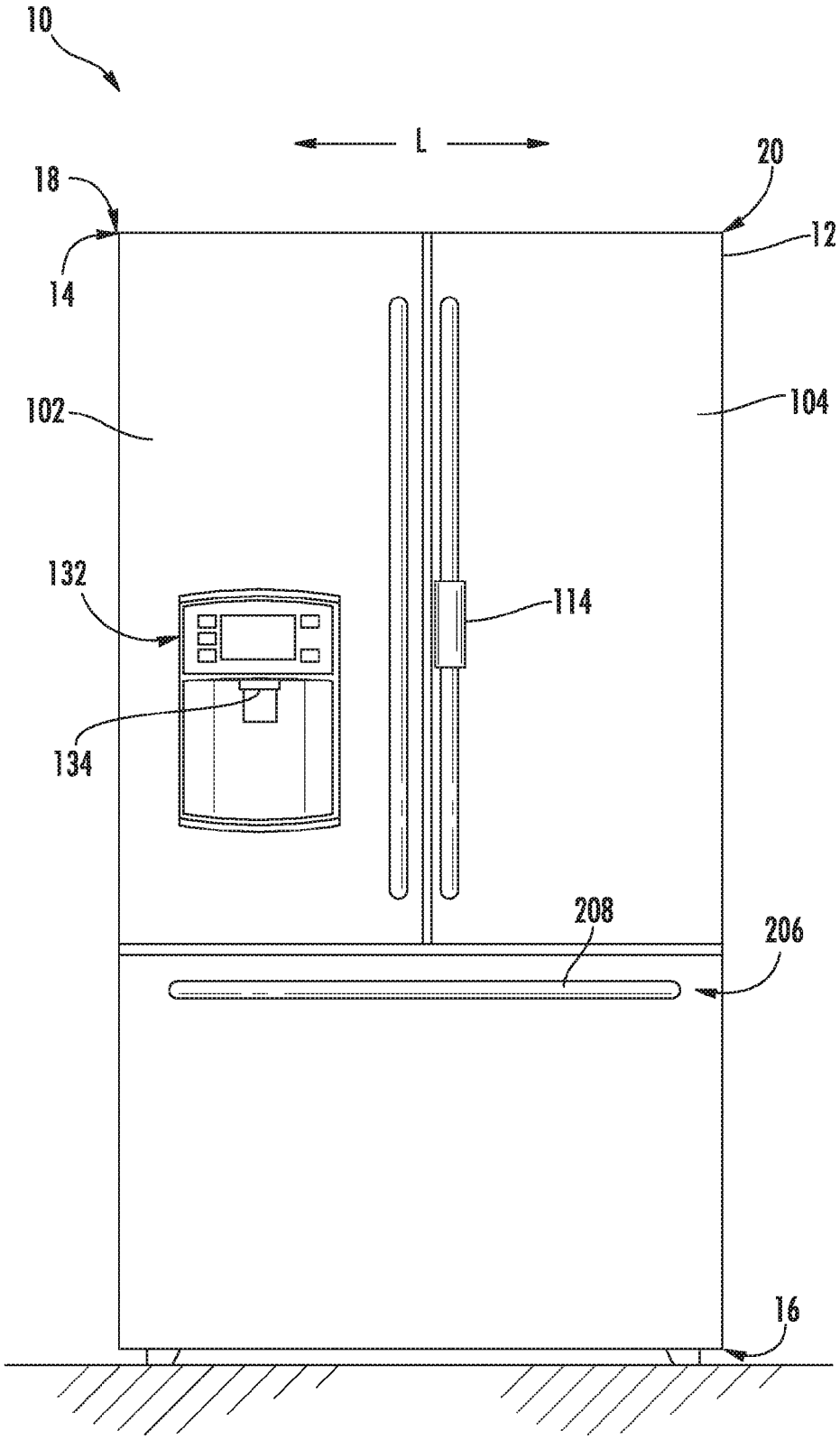
FIG. 5 provides a front elevation view of a refrigerator appliance according to another exemplary embodiment of the present subject matter with the doors shown in the closed position.
Figure 7:
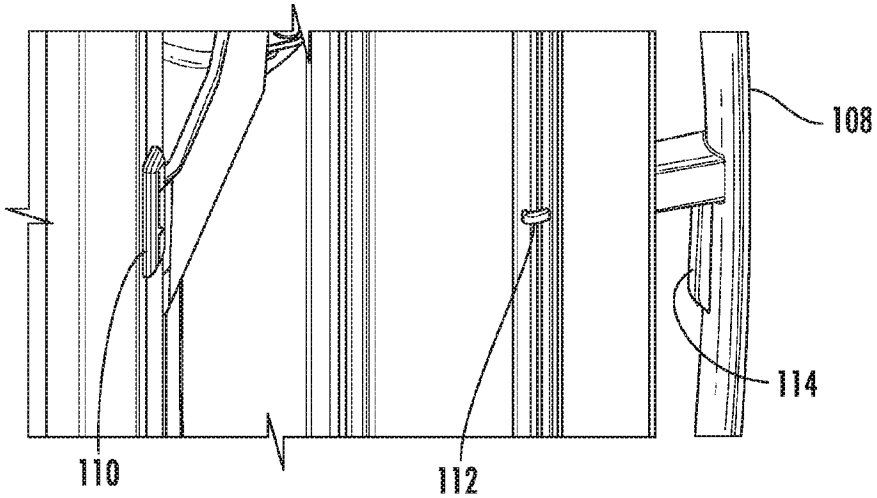
Figure 8:
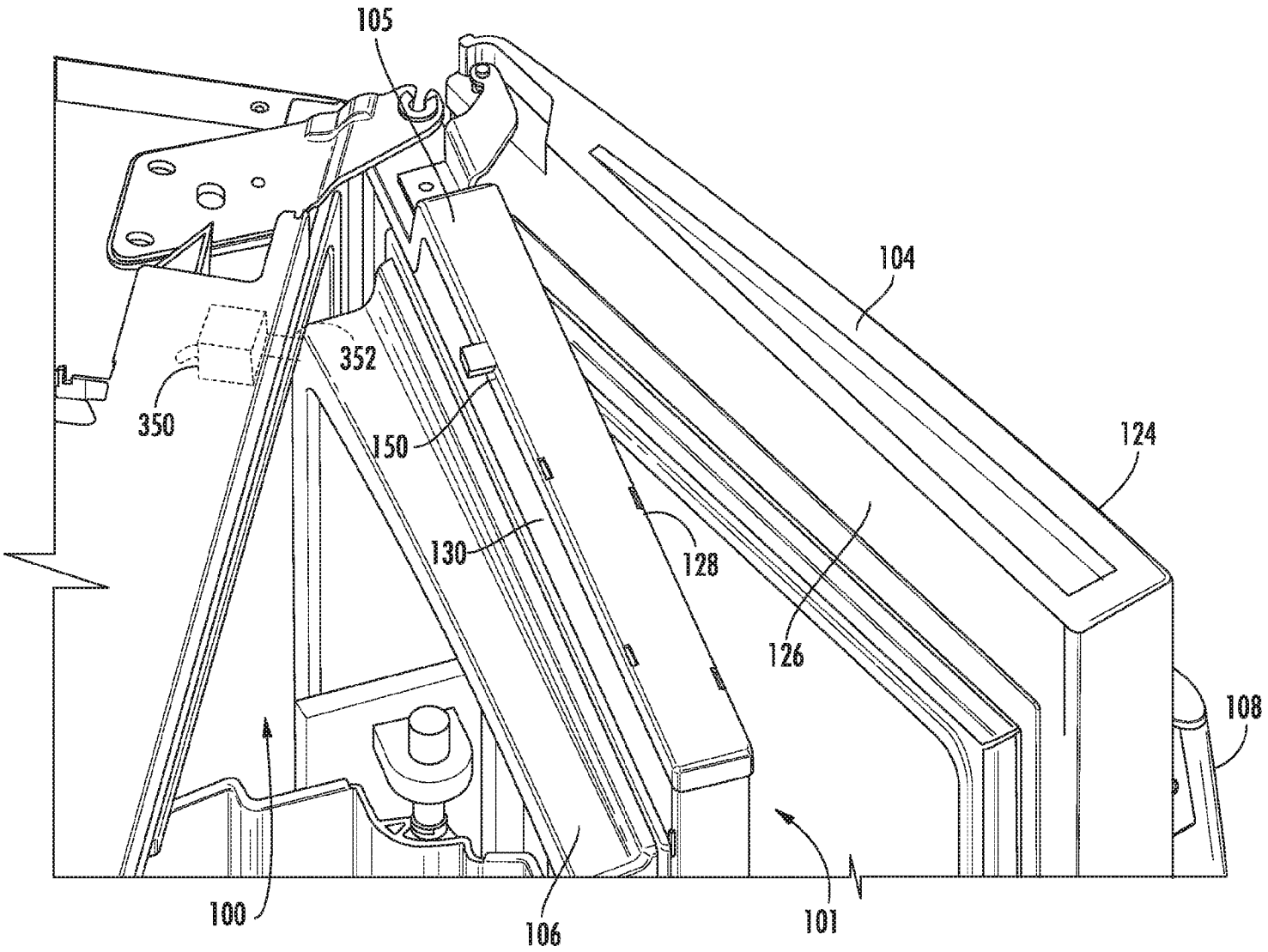
FIG. 8 provides a perspective view of the exemplary refrigerator appliance of FIG. 5 with the doors of the exemplary refrigerator appliance in an unlocked, partially open position.
Figure 9:
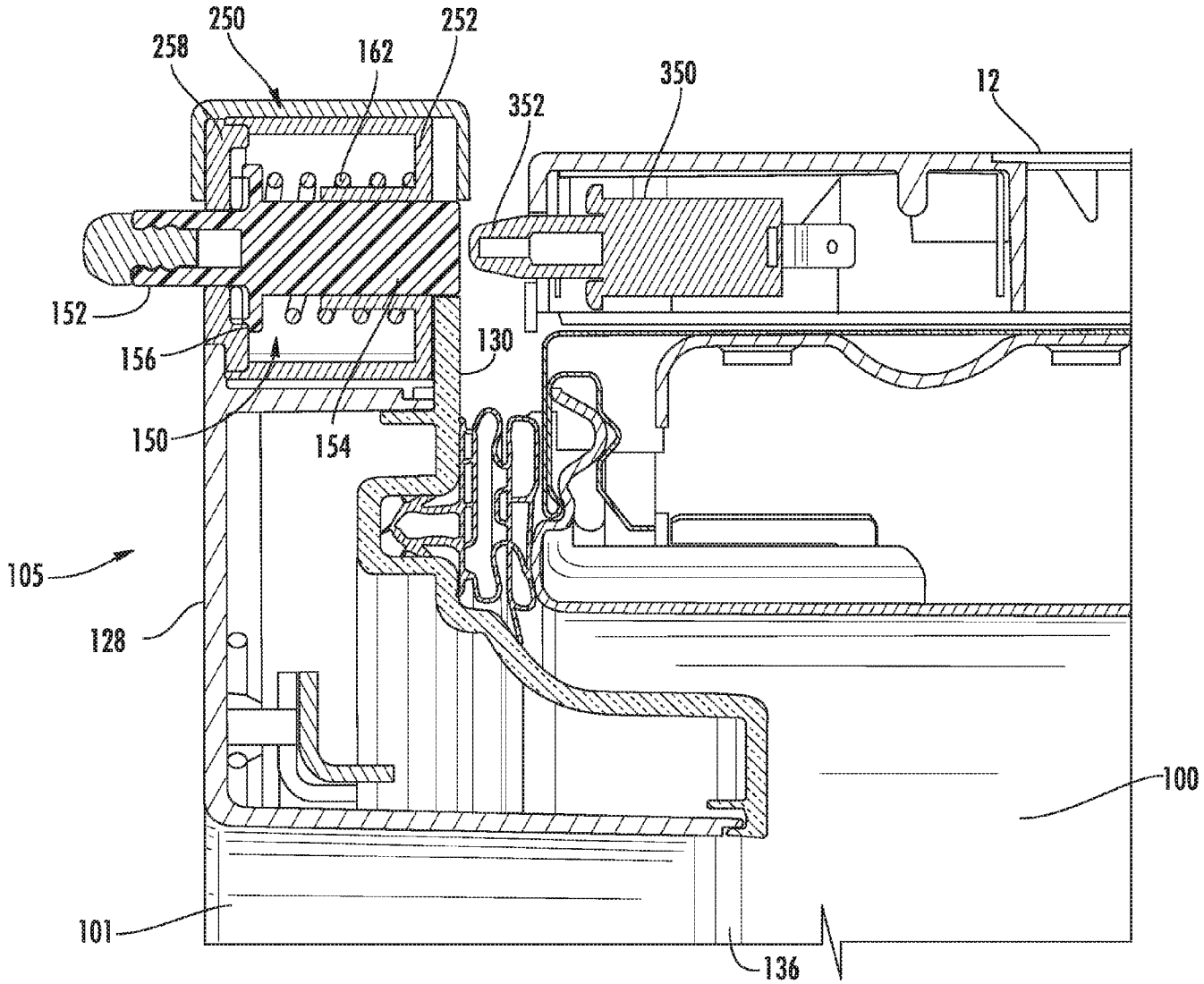
FIG. 9 provides a side section view of an exemplary cabinet and inner door including a switch and actuator disposed in the cabinet and inner door, respectively.
Figure 10:
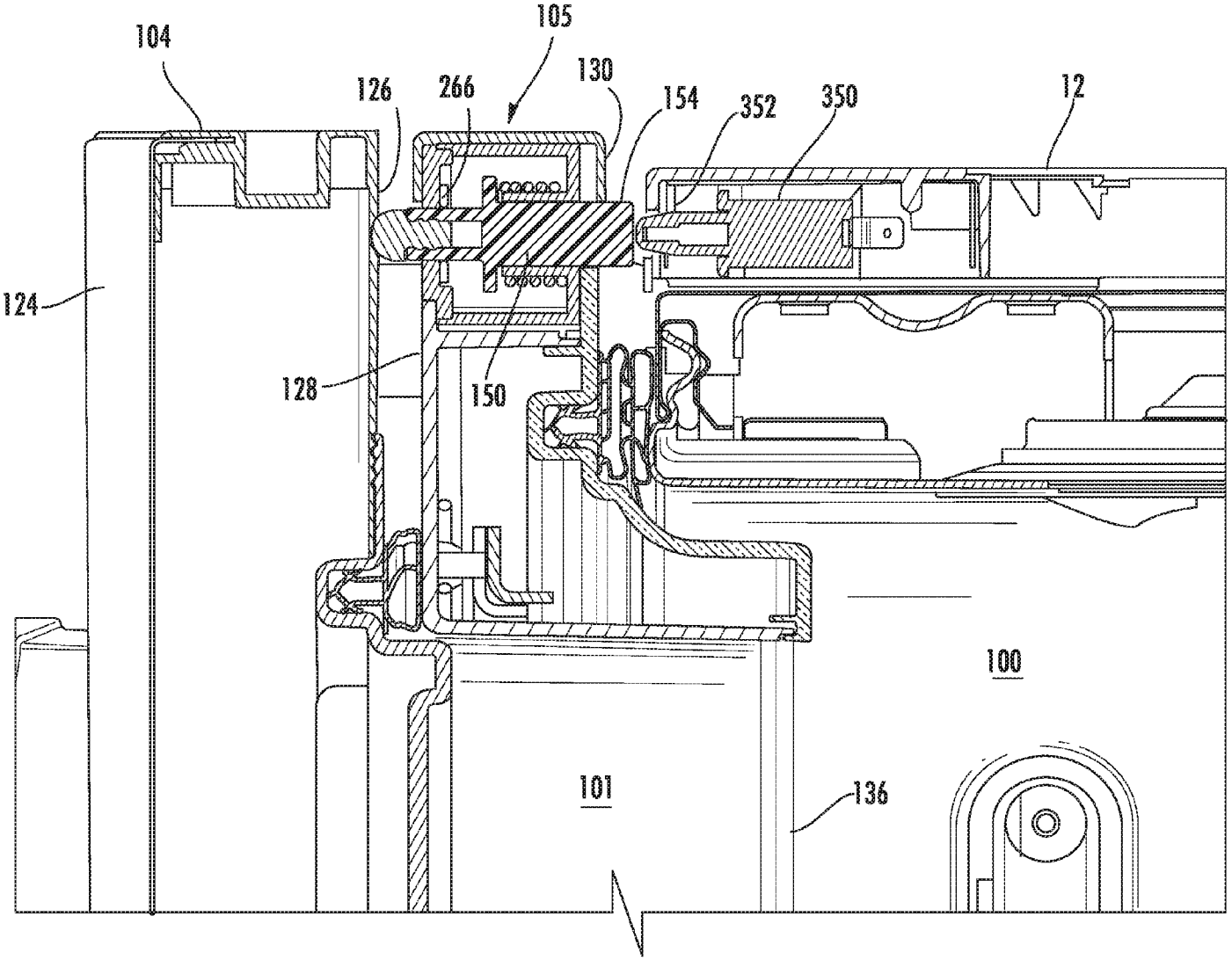
FIG. 10 provides a side section view of an exemplary cabinet, inner door, and outer door with the outer door in the closed position.
Figure 11:
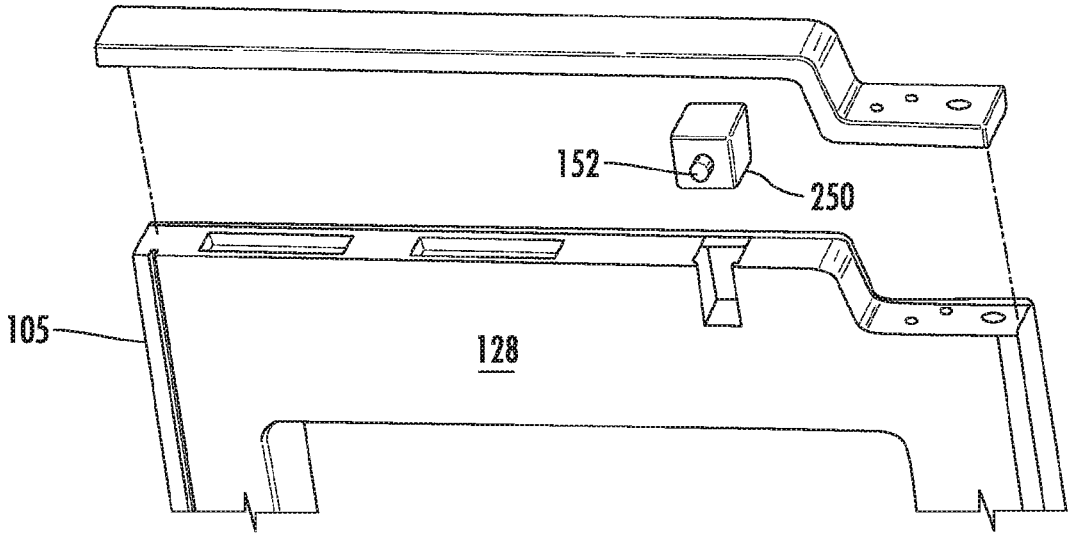
FIG. 11 provides a partial exploded view of an exemplary inner door and actuator.

FIG. 5 provides a front, elevation view of a refrigerator appliance 10 according to an exemplary embodiment of the present subject matter which includes a nesting door assembly comprising inner refrigerator door 105 and the outer refrigerator door 104 outboard of the inner door 105. FIGS. 6 and 7 illustrate an exemplary embodiment wherein nesting door assembly comprising inner door 105 and outer door 104 is rotatably mounted at the front of fresh food chamber 100 with latch 112 selectively locking doors 104 and 105 together. FIG. 8 illustrates example embodiments of the actuator 150, housing 250, outer door 104 and inner door 105. FIGS. 9 and 10 illustrate example embodiments of the actuator 150 and switch 350 which provide for illuminating the light 300 when either or both inner door 105 and outer door 104 are open. As discussed in greater detail below, refrigerator appliance 10 includes features for assisting with visibility (i.e., illumination) and accessibility of food items stored therein.

In embodiments that include an inner door and an outer door that are both rotatable, e.g., 104 and 105 as illustrated in FIGS. 6 and 7, a latch 112 can be provided to lock the inner door (e.g., refrigerator door 105) with the outer door (e.g., refrigerator door 104). As shown in FIG. 6, in some exemplary embodiments, latch 112 may be provided on outer door 104 and a mating catch 110 may be provided on inner door 105. Also in some embodiments, the handle 108 of the outer door 104 may have a button 114 mounted thereon, for example as illustrated in FIG. 7, whereby a user may grasp the handle 108 of outer door 104, press button 114 to release latch 112 from catch 110 and thereby unlock outer door 104 from inner door 105 permitting outer door 104 to open freely independent of inner door 105, e.g., for access to the bins 116 illustrated in FIG. 6 and/or second fresh food storage chamber 101 without opening inner door 105. Alternatively, operating handle 108 without activating button 114 permits opening outer door 104 and inner door 105 together for full access to food storage chamber 100. Also illustrated in the example embodiment of FIG. 8, the inner door 105 defines a frame 106 of second fresh food storage chamber 101 and outer door 104 sealingly encloses the second fresh food storage chamber 101 when outer door 104 is in the closed position. Thus, the inner door, e.g., refrigerator door 105, may also be considered as a frame door.

FIGS. 9 and 10 provide further illustration of possible embodiments for the switch 350 and actuator 150 in context of an inner door and outer door. In FIGS. 9 and 10, the inner door and outer door are illustrated for example as refrigerator doors 105 and 104, respectively. However, other locations are possible, e.g., the actuator 150 can also be provided in freezer drawer front portion 205 in line with a switch 350 in the cabinet 12 proximate to the first frozen food storage chamber 200 and will work in substantially the same manner. In FIG. 9, actuator 150 is in a forward position proximate the outer surface 128 of the inner door 105 and switch 350 is in a forward position which is also the default or neutral position for the switch 350. In FIG. 10, actuator 150 is in a back position proximate the inner surface 130 of the inner door 105 and body 154 is engaged with plunger 352 of switch 350 to move switch 350 to a back position. Actuator 150 may be biased by a biasing member, for example the actuator 150 may be spring-loaded with spring 162 which biases the actuator 150 forward and away from the switch 350. Biasing member 162 urges actuator to the forward position shown in FIG. 9. Thus, actuator 150 can be configured such that when is not acted upon by, e.g., the outer door 104, the default or neutral position of actuator 150 is the forward position.

As illustrated in FIG. 9, actuator 150 includes a plunger portion 152 at its outer end, an inner body portion 154, and a flange 156 between the plunger 152 and the body 154. Also illustrated in FIG. 9, switch 350 includes a front contact portion 352, which in the example illustrated is a plunger 352, and switch 350 is operatively connected to an electrical circuit (not shown) that supplies power to the light 300 to illuminate the corresponding food storage chamber(s), e.g., the fresh food storage chambers 100, 101 in the example embodiment illustrated in FIGS. 9 and 10. When switch 350 is not acted upon by, e.g., body portion 154 of actuator 150, switch 350 will be in its neutral position, e.g., as shown in FIG. 9, where plunger 352 protrudes forward out of cabinet 12. In this neutral position, the electric circuit supplying power to light 300 will be closed and light 300 will illuminate.

As illustrated for example in FIG. 10, outer door 104 includes an outer surface 124 and an opposing inner surface 126, such that when the outer door 104 is closed, inner surface 126 of the outer door 104 will engage the actuator 150, and in the illustrated embodiments, plunger 152 in particular, so that the actuator 150 moves a predetermined distance inward towards the cabinet 12. In the illustrated embodiments, inner surface 126 is a flat surface, but it is also possible within the scope of the present subject matter to provide inner surface 126 in various shapes or configurations to engage actuator 150. For example, inner surface 126 may include a convex surface or a ridge that extends inward towards actuator 150 to engage actuator 150 and cause the actuator 150 to move the predetermined distance towards cabinet 12 in order to engage switch 350. Additional variations of the inner surface 126 and actuator 150 similar to those described below with respect to actuator body 154 and switch contact portion 352 are also possible within the scope of the present subject matter. When the actuator 150 moves the predetermined distance, the body 154 of the actuator 150 engages the plunger 352 of switch 350 such that the plunger 352 also moves the predetermined distance, and the switch 350 can then open the circuit supplying power to the light 300 so that the light 300 will deactivate. The switch 350 will return to its neutral position whenever it is not engaged, e.g., by the actuator 150. The actuator 150 can move away from the switch 350 by moving relative to the inner door 105, e.g., when outer door 104 is opened such as illustrated in FIG. 9. Also, the actuator 150 will be carried by the inner door 105 when the inner door 105 is opened, such that the actuator 150 can move away from and disengage the switch 350 without moving relative to the inner door 105. In other words, when the inner door 105 is in the open position, the actuator 150 positioned therein is disengaged from the switch 350 whether the actuator 150 is in the back position or in the forward position.

In many cases, the actuator 150 will move along the transverse direction as it engages with and disengages from switch contact portion 352. For example, when inner door 105 or 205 is closed and actuator 150 moves from its neutral position in response to the outer door(s) 104 or 202, 204 moving to the closed position. Also, in embodiments where inner door is slidably mounted on cabinet 12, e.g., inner door 205 in FIG. 3, actuator will move along the transverse direction either relative to inner door 205, e.g., when outer door(s) 202, 204 move to the open position while inner door 205 is in the closed position, or with inner door 205, e.g., when inner door 205 slides out away from cabinet 12 along the transverse direction both inner door 205 and actuator 150 will move together along the transverse direction. However, in other cases, such as embodiments wherein inner door (e.g., inner door 105 in FIG. 6) is rotatably mounted to cabinet 12, actuator may move other than along the transverse direction, for instance within a plane that includes both the lateral (L) and transverse (T) directions. Thus, the present subject matter is not limited to a particular direction of movement for actuator 150, so long as actuator 150 disengages switch 350 when either the inner door 105 or 205 or the outer door(s) 104 or 202, 204 move from the closed position.

The light is activated when the switch is in the forward position (e.g., as illustrated in FIG. 9) and deactivated when the switch moves toward the back portion of the first food storage chamber a predetermined distance from the forward position to the back position (e.g., as illustrated in FIG. 10). In other words, switch 350 is configured to turn on the light 300 in response to one of doors 102, 104, 105, 202, 204, and/or 205 moving from the closed position to the open position. For example, a pair of electrical contactors may be provided in operative communication with plunger 352, such that the electrical contactors will contact one another to close the circuit supplying power to light 300 when the switch 350 is in its neutral position, and switch 350 can separate the contactors and open the circuit when switch 350, and in particular, plunger 352, is engaged by actuator 150. In the illustrated embodiments, switch 350 includes a plunger 352 which protrudes forward from cabinet 12 to contact the body 154 of the actuator 150. However, it is also possible within the scope of the present subject matter to provide a switch 350 with a contact portion 352 that is essentially flush with the outer surface of cabinet 12 (for example, a piezoelectric pad that responds to pressure from actuator body 154) or that is positioned within a recess of cabinet 12. For example, the tip of plunger 352 could be flush with outer surface of cabinet 12 or inside of cabinet 12 when in the neutral position. In such embodiments, actuator body 154 could be correspondingly lengthened to accommodate the additional distance between inner surface 130 of inner door 105 and the contact portion 352 of switch 350. It is also possible within the scope of the present subject matter to provide a contact portion 352 other than a plunger, as but one possible example, the switch 350 could include a movable plate. In various embodiments, the actuator body 154 may be shaped correspondingly to engage contact portion 352 of switch 350, e.g., body 154 may be convex while contact portion 352 may be concave.

As mentioned above, actuator 150 may be biased by a biasing member, such as spring 162. In some embodiments, spring 162 may be positioned between an outer surface 256 of the inner wall 252 of the housing 250 and an inner surface 158 of the flange 156 of the actuator 150 so as to bias the actuator 150 forward and away from the switch 350. The biasing member 162 urges the actuator 150 forward (i.e., towards outer surface 128 of inner door 105) along the transverse direction when the inner door 105 is in the closed position. Inasmuch as the inner door 105 may be rotated between an open position and a closed position within a plane that includes both the lateral (L) and transverse (T) directions, when inner door 105 rotates ninety degrees from the closed position towards the open position, actuator 150 therein would then be biased towards the outer surface 128 of inner door 105 along the lateral direction. As illustrated in the example embodiments of FIGS. 9 and 10, biasing element 162 may be a coil spring encircling the body 154 of actuator 150. Because the actuator 150 is biased, it will also act as open assist for outer door 104 allowing it to self-open to more than 45° when the outer door 104 is unlocked from inner door 105, e.g., by releasing latch 112. When the outer door 105 is in the closed position, the spring 162 is under tension and when the outer door 105 is opened (i.e., when latch 112 is released to unlock outer door 104 from inner frame door 105), the spring force acts on the flange 156 and plunger 152 which in turn acts on inner surface 126 of outer door 104 such that outer door 104 releases to the open position and the body 154 of actuator 150 will disengage from switch 350 in cabinet 12. The biasing force acting on outer door 104 will allow it to automatically open at least a few degrees upon release of latch 112, e.g., the spring-loaded actuator 150 provides door open assist, and at the same time the light 300 is turned ON due to disengagement of the actuator 150 from switch 350. Other biasing members are possible within the scope of the present subject matter, such as a leaf spring or other resilient member which may be integrally formed with housing 250 or may otherwise be positioned between actuator 150 and housing 250 to bias actuator 150 to its neutral position away from switch 350 and in particular contact portion 352.

Figure 12:
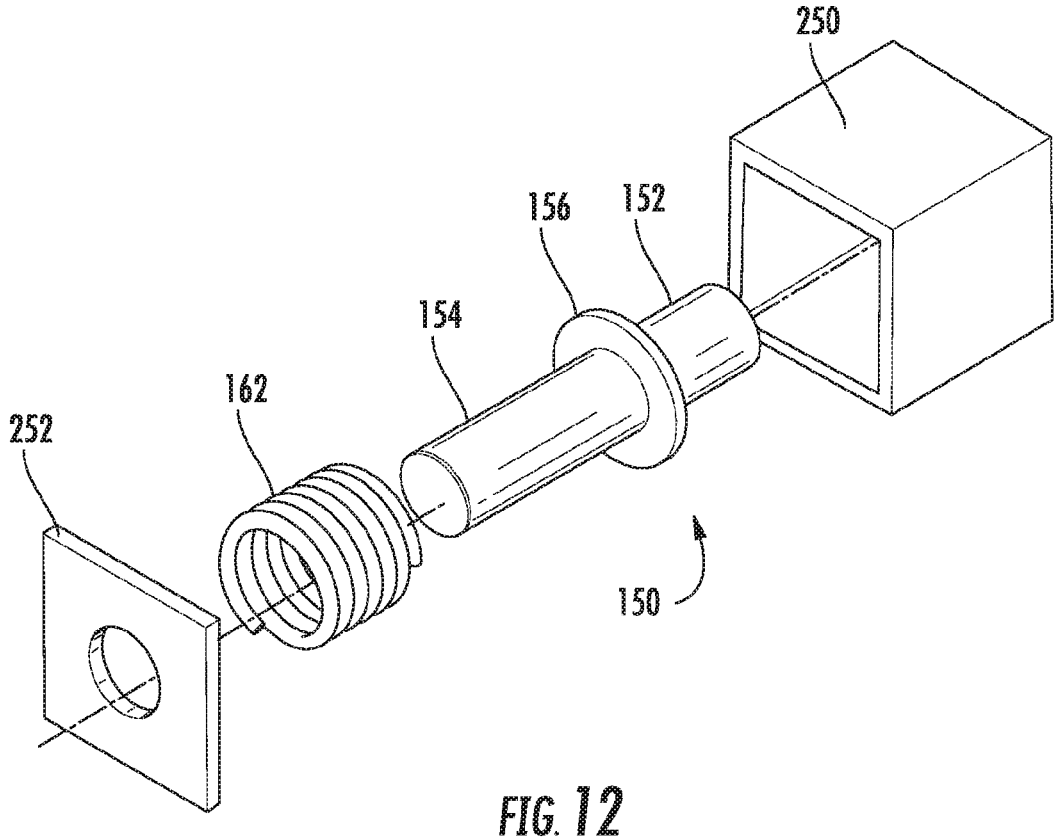
FIG. 12 provides an exploded view of an exemplary actuator and housing.
Figure 13:
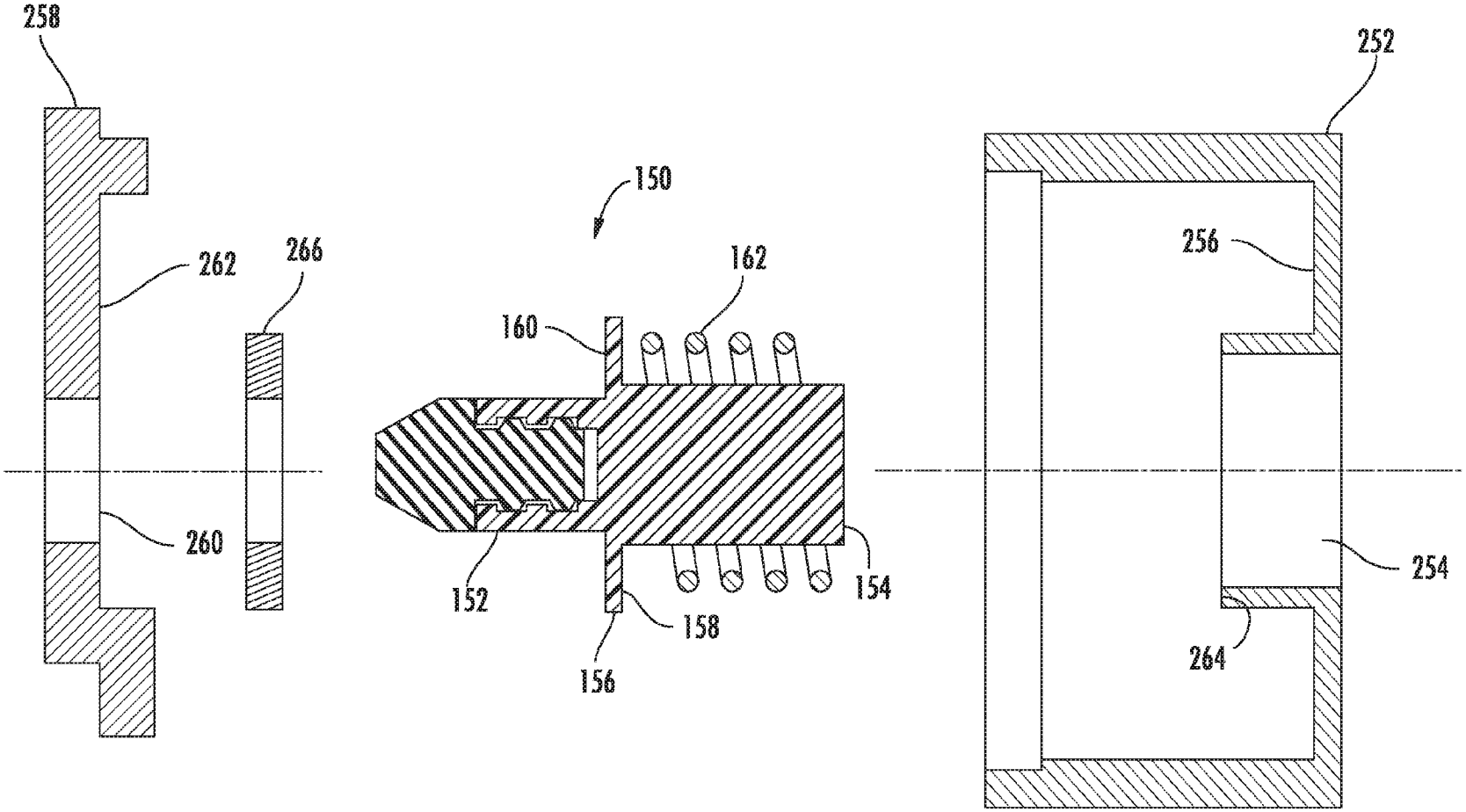
FIG. 13 provides an exploded side section view of an exemplary housing and actuator.

As illustrated in the example embodiments of FIGS. 9, 10, 12 and 13, outer wall 258 includes an aperture 260 with the plunger 152 of the actuator 150 extending therethrough, and the inner wall 252 of housing 250 includes an aperture 254 with the body 154 of the actuator 150 extending therethrough. Further, the exemplary embodiment illustrated in FIGS. 9, 10, and 13 includes a wall 264 extending perimetrically around the aperture 254 of the inner wall 252 and extending toward the outer wall 258 of the housing 250. Also illustrated in for example FIGS. 10 and 13, a washer 266 can be disposed around the aperture 260 of the outer wall 258 of the housing 250 between an inner surface 262 of the outer wall 258 of the housing 250 and an outer surface 160 of the flange 156 of the actuator 150. The movement of the actuator 150 may be limited by the washer 266 and wall 264 or inner wall 256. As such, the predetermined distance which the actuator 150 moves from its neutral position to engage switch 350 is defined by the distance between washer 266 and wall 264 or inner wall 256 (subtracting the thickness of flange 156). For example, as illustrated in FIG. 9, outward movement of actuator 150 is limited by engagement of outer surface 160 of flange 156 with washer 266. As such, washer 266 provides a physical cushion between the actuator 150 and the housing 250 as well as an acoustic muffle to avoid an audible click when the force of biasing member 162 biases actuator 150 into contact with outer wall 258 of housing 250. Washer 266 may also serve as an attachment mechanism to aid in connecting and aligning various parts, e.g., washer 266 may enhance alignment of plunger 152 with aperture 260. Preferably, washer 266 is formed of a low-friction material such as polytetrafluoroethylene. As seen in the illustrative example of FIG. 8, inward movement of actuator 150 is resisted by the spring force of spring 162 and limited by engagement of inner surface 158 of flange 156 with wall 264, in other embodiments, e.g., as illustrated in FIG. 12, wall 264 may be omitted such that inner wall 252 and/or biasing member 162 may provide the limit for inward movement of actuator 150. Also, in some embodiments wall 264 may serve as biasing member 162, e.g., wall 264 may be formed of a resilient material such as plastic or spring metal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a first food storage chamber, the first food storage chamber extending between a top portion and a bottom portion along the vertical direction, a first side portion and a second side portion along the lateral direction, and a front portion and a back portion along the transverse direction, the front portion of the first food storage chamber defining an opening for receipt of food items;

an inner door comprising an outer surface and an opposing inner surface, the inner door positioned at the front portion of the food storage chamber and movable between a closed position and an open position to selectively sealingly enclose the first food storage chamber;

an outer door rotatably mounted to the outer surface of the inner door, the outer door comprising an outer surface and an opposing inner surface;

a second food storage chamber defined between the inner door and the outer door, the outer door movable between an open position and a closed position to permit selective access to the second food storage chamber;

a light positioned for illuminating the first food storage chamber and the second food storage chamber;

a switch positioned within the cabinet and in operative communication with the light;

an actuator movable between a forward position proximate the outer surface of the inner door and a back position proximate the inner surface of the inner door, wherein the actuator engages the switch to deactivate the light when the inner door is in the closed position and the actuator is in the back position; and a biasing member engaged with the actuator to bias the actuator towards the forward position.

2. The refrigerator appliance of claim 1, wherein the switch is movable between a forward position of the switch and a back position of the switch, the light is activated when the switch is in the forward position and deactivated when the switch moves toward the back portion of the first food storage chamber a predetermined distance from the forward position of the switch to the back position of the switch.

3. The refrigerator appliance of claim 2, wherein the switch comprises a plunger, the plunger projecting forward from the cabinet along the transverse direction when the switch is in the forward position of the switch.

4. The refrigerator appliance of claim 1, wherein the actuator comprises a plunger, a body and a flange between the plunger and the body.

5. The refrigerator appliance of claim 4, wherein the inner surface of the outer door engages the plunger of the actuator to move the actuator from the forward position of the actuator to the back position of the actuator when the outer door is in the closed position.

6. The refrigerator appliance of claim 4, wherein the body of the actuator engages the plunger of the switch when the inner door is in the closed position and the actuator is in the back position of the actuator.

7. The refrigerator appliance of claim 4, further comprising a housing disposed within the inner door, the actuator disposed within the housing and movable within the housing between the back position of the actuator and the forward position of the actuator.

8. The refrigerator appliance of claim 7, wherein the housing comprises an outer wall extending in the vertical direction proximate the outer surface of the inner door, the outer wall comprising an aperture with the plunger of the actuator extending therethrough, an inner wall extending in the vertical direction proximate the inner surface of the inner door, the inner wall comprising an aperture with the body of the actuator extending therethrough, and a wall extending perimetrically around the aperture of the inner wall and extending toward the outer wall of the housing.

9. The refrigerator appliance of claim 8, wherein the biasing element is a coil spring encircling the body of the actuator, and the spring engages with an inner surface of the flange of the actuator and an outer surface of the inner wall of the housing.

10. The refrigerator appliance of claim 8, further comprising a washer disposed around the aperture of the outer wall of the housing between an inner surface of the outer wall of the housing and an outer surface of the flange of the actuator.

11. The refrigerator appliance of claim 1, wherein the first food storage chamber is a fresh food storage chamber for receipt of fresh food articles, and the cabinet further defines a frozen food storage chamber for receipt of frozen food articles.

12. The refrigerator appliance of claim 1, wherein the first food storage chamber is a frozen food storage chamber for receipt of frozen food articles, the cabinet further defines a fresh food storage chamber for receipt of fresh food articles, and the inner door is a front portion of a freezer drawer slidably mounted within the frozen food storage chamber such that the freezer drawer is disposed within the frozen food storage chamber when the freezer drawer is in a closed position and is at least partially disposed outside the frozen food storage chamber when the freezer drawer is in an open position, the closed position and the open position being separated from each other along the transverse direction.

13. A refrigerator appliance defining a vertical direction, a lateral direction, and a transverse direction, the vertical, lateral, and transverse directions being mutually perpendicular, the refrigerator appliance comprising:

a cabinet defining a food storage chamber;

the food storage chamber comprising an opening positioned at a front portion of the food storage chamber;

a nesting door assembly mounted at a front portion of the cabinet, the nesting door assembly comprising an inner door, an outer door, and a latch operable to selectively lock the inner door and the outer door together and unlock the inner door and the outer door to permit each door to move independently of the other;

the inner door movable between an open position and a closed position to permit selective access to the food storage chamber;

the outer door movable between an open position and a closed position to permit selective access to a portion of the food storage chamber;

a light positioned to illuminate the food storage chamber; and a switch apparatus in operative communication with the light;

wherein the switch apparatus is configured to turn the light on when the inner door is in the open position, to turn the light on when the outer door is in the open position, and to turn the light off when both the inner door and the outer door are in the respective closed positions.

14. The refrigerator appliance of claim 13, wherein the switch apparatus comprises an electrical switch positioned in the cabinet and a mechanical actuator disposed within a housing in the inner door.

15. The refrigerator appliance of claim 14, wherein the mechanical actuator comprises a body portion, a plunger portion forward of the body portion, and a flange between the body portion and the plunger portion.

16. The refrigerator appliance of claim 15, wherein the switch apparatus further comprises a biasing element positioned between the housing and the flange to bias the mechanical actuator forward along the transverse direction away from the electrical switch to a neutral position.

17. The refrigerator appliance of claim 14, wherein the electrical switch comprises a plunger movable along the transverse direction from the neutral position where the plunger of the electrical switch projects forward from the cabinet, the switch apparatus operable to deactivate the light when the plunger of the electrical switch moves inward toward the cabinet a predetermined distance from the neutral position.

18. The refrigerator appliance of claim 17, wherein the outer door comprises an outer surface and an inner surface positioned opposite of and facing away from the outer surface, the inner surface of the outer door engages the plunger portion of the mechanical actuator to move the mechanical actuator against the biasing force of the biasing element until the body portion of the mechanical actuator engages the plunger of the electrical switch and moves the plunger of the electrical switch inward the predetermined distance from the neutral position when the front door is in the closed position and the rear door is in the closed position.

* * * * *